US012698685B2

(12) United States Patent
Batarseh

(10) Patent No.: US 12,698,685 B2
(45) Date of Patent: Aug. 4, 2026

(54) SLACK MANAGEMENT

(71) Applicant: SAUDI ARABIAN OIL COMPANY, Dhahran (SA)

(72) Inventor: Sameeh Issa Batarseh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/616,582

(22) Filed: Mar. 26, 2024

(65) Prior Publication Data

US 2025/0305376 A1 Oct. 2, 2025

(51) Int. Cl.
*E21B 19/22* (2006.01)
*E21B 23/14* (2006.01)

(52) U.S. Cl.
CPC ..... *E21B 19/22* (2013.01); *E21B 23/14* (2013.01)

(58) Field of Classification Search
CPC ..... E21B 19/22; E21B 23/14
USPC ..... 166/77.2
See application file for complete search history.

(56) References Cited

U.S. PATENT DOCUMENTS 3,758,701 A * 9/1973 Schmidt ..... H01B 7/29 174/15.5
5,267,377 A * 12/1993 Gillis ..... A44B 11/2511 24/641
5,742,002 A * 4/1998 Arredondo ..... H01B 11/1847 174/126.3
5,992,468 A * 11/1999 Dwiggins ..... E21B 23/01 138/131
5,996,689 A 12/1999 Head
6,167,915 B1 * 1/2001 Collie ..... H01B 7/189 166/241.1
7,424,176 B2 9/2008 Kension et al.
7,905,295 B2 3/2011 Mack
9,982,805 B2 * 5/2018 Paetow ..... H02G 3/22
(Continued)

FOREIGN PATENT DOCUMENTS

EP 3494276 A1 6/2019
GB 2322740 A 9/1998
NO 20130360 A1 9/2014

OTHER PUBLICATIONS

PCT International Search Report & Written Opinion pertaining to International Application No. PCT/US2025/021096; Date of Mailing: May 30, 2025.

*Primary Examiner* — Tara Schimpf
*Assistant Examiner* — Patrick F Lambe
(74) *Attorney, Agent, or Firm* — Vorys, Sater, Seymour and Pease LLP

(57) ABSTRACT

A wellbore system includes coiled tubing extending into a wellbore from a surface location and a downhole tool coupled to a downhole end of the coiled tubing. A cable extends through the coiled tubing and is operably coupled to the downhole tool within the wellbore. An insert is disposed within the coiled tubing and engages the cable. The insert includes a plurality of elongated rods radially spaced around the cable and defining a longitudinal axis of the insert, and a plurality of retractable bars extending radially inwardly from the elongated rods. The retractable bars are biased radially inward to an extended position wherein the retractable bars flex the cable into an undulating configuration with respect to the longitudinal axis, and the retractable bars are responsive to an increased tension in the cable to move radially outward to a retracted configuration.

20 Claims, 3 Drawing Sheets

(56) References Cited

U.S. PATENT DOCUMENTS

| | | | | |
|---|---|---|---|---|
| 10,246,960 | B2 * | 4/2019 | Shepler | E21B 43/128 |
| 2009/0308618 | A1 * | 12/2009 | Collie | E21B 19/22<br>166/385 |
| 2017/0145760 | A1 | 5/2017 | Poyet et al. | |

* cited by examiner

SLACK MANAGEMENT

FIELD OF THE DISCLOSURE

The present disclosure relates generally to coiled tubing operations in subterranean wellbores, and more particularly, to detecting and managing the slack in a cable extending through (within) the coiled tubing.

BACKGROUND OF THE DISCLOSURE

Coiled tubing is generally a continuous length (often in the range of about 2,000 feet to about 30,000 feet) of flexible steel pipe coiled on a spool and used in the oil and gas industry. Coiled tubing has been used in various wellbore operations such as workover, intervention and drilling operations. The coiled tubing is used to convey wellbore tools downhole, circulate fluids and to perform other functions. Using a single continuous length of pipe provides several advantages including rapid deployment and withdrawal without the need for making or breaking connections between pipe sections, and also withstanding significant downhole pressures. Coiled tubing is also able to pass through production tubing without interrupting production operations where oil and/or gas are brought to the surface.

Coiled tubing is often used to convey electrically or hydraulically powered wellbore tools coupled to a downhole end of the coiled tubing. This has resulted in an inner cable (e.g., conventional electrical wire-line logging cables or small hydraulic conduits) being inserted (extended) into the interior of the coiled tubing so that sophisticated services can be performed. Friction between the inner cable and the coiled tubing may cause the coiled tubing and the inner cable to move at different rates causing a shortage in the inner cable. This shortage may impede deployment of the coiled tubing into the wellbore.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore system includes coiled tubing extending into a wellbore from a surface location and a downhole tool coupled to a downhole end of the coiled tubing. A cable extends through the coiled tubing and is operably coupled to the downhole tool within the wellbore. An insert is disposed within the coiled tubing and engages the cable. The insert includes a plurality of elongated rods radially spaced around the cable and defining a longitudinal axis of the insert, and a plurality of retractable bars extending radially inwardly from the elongated rods. The retractable bars are biased radially inward to an extended position wherein the retractable bars flex the cable into an undulating configuration with respect to the longitudinal axis, and the retractable bars are responsive to an increased tension in the cable to move radially outward to a retracted configuration.

According to another aspect, the disclosure is directed to a method of deploying a downhole tool including (a) installing an insert on a cable to bias the cable into an undulating configuration, the insert including a plurality of elongated rods radially spaced around the cable and a plurality of retractable bars extending radially inwardly from the elongated rods and biased radially inward to an extended position, (b) inserting the insert and the cable through coiled tubing, (c) coupling the downhole tool to a downhole end of the coiled tubing and a downhole end of the cable; and (d) deploying the downhole tool into the wellbore on the coiled tubing such that operational forces apply a tensile force to the cable within the coiled tubing such that the cable imparts a radial outward force on the retractable bars and such that the retractable bars move radially outward to a retracted configuration.

According to still another aspect, the disclosure is directed to a tubing assembly for deploying a downhole tool in a wellbore. The tubing assembly includes coiled tubing and a cable extending through the coiled tubing. The cable is operable to transmit electrical and/or hydraulic signals therethrough. The assembly further includes a plurality of elongated rods disposed within the coiled tubing and radially spaced around the cable and a plurality of retractable bars extending radially inwardly from the elongated rods. The retractable bars are biased radially inward to an extended position wherein the retractable bars flex the cable into an undulating configuration, and the retractable bars are responsive to an increased tension in the cable to move radially outward to a retracted configuration.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
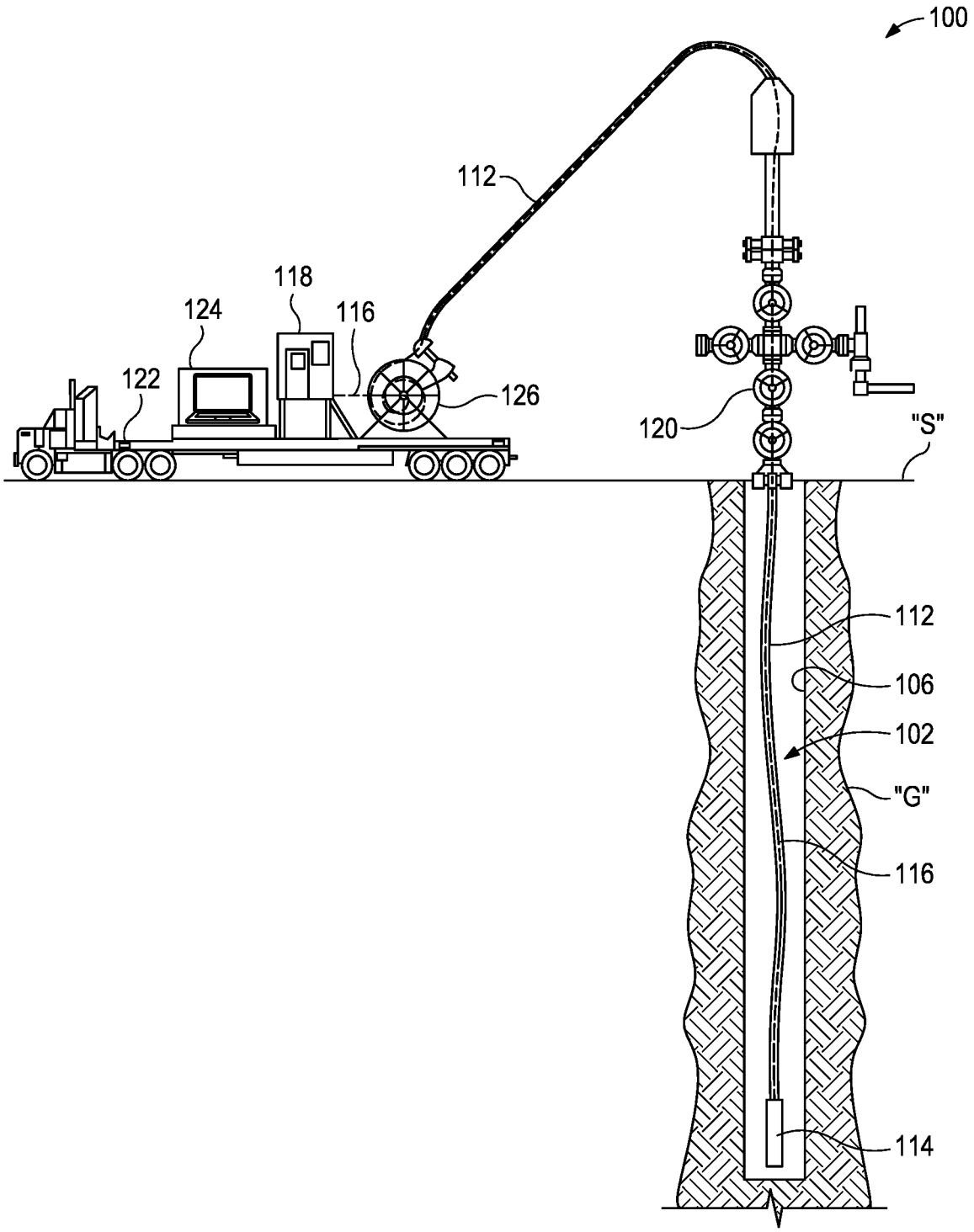
FIG. 1 is a cross-sectional view of a wellbore system including a downhole tool conveyed into a wellbore on coiled tubing in accordance with one or more aspects of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to systems and methods for imparting slack into a cable extending though coiled tubing. One or more inserts may be installed on the cable such that retractable bars on the insert engage the cable to impart an undulating shape to the inner cable. The cable may then be inserted into the coiled tubing, and the coiled tubing may be deployed into the wellbore. In operation, the cable may be straightened by operational forces, and the straightening may move the retractable bars to a retracted configuration while slack from the cable is removed. In some embodiments, an amount of force imparted on the cable by the retractable bars may be adjusted by screws or other mechanisms provided on the one or more inserts.

FIG. 1 is a schematic view of an example wellbore system 100 including a tubing assembly 102 in accordance with one or more embodiments of the disclosure. The wellbore system 100 includes a wellbore 106 extending from a surface location "S" and traversing a geologic formation "G." In the illustrated example, the wellbore 106 is substantially vertical. In other embodiments, aspects of the disclosure may be practiced in a wide variety of vertical, directional, deviated, slanted and/or horizontal portions therein, and may extend along any trajectory through the geologic formation "G." As illustrated in FIG. 1, the wellbore 106 is open hole, but in other embodiments, the wellbore may be at least partially lined with a casing string (not shown) without departing from the scope of the disclosure.

In the illustrated embodiment, the tubing assembly 102 includes a continuous length of flexible coiled tubing 112 extending into the wellbore 106 from the surface location "S." The coiled tubing 112 may be raised and lowered from the surface location for the selective placement and retrieval of a downhole tool 114 coupled to a downhole end of the tubing assembly 102. The downhole tool 114 may include any number of logging tools for gathering pressure, temperature and flow data, perforating tools for perforating the geologic formation, or other tools operable for other interventions to change or adjust downhole equipment such as valves or pumps.

As described in greater detail below, a cable 116 may extend through the coiled tubing 112 to operably couple the downhole tool 114 to a power system 118 and/or other equipment at the surface location "S." The cable 116 may include one or more electrical conductors and/or hydraulic conduits, and the power system 118 may include generators for supplying electrical power to the downhole tool 114 as well as compressors, accumulators or other hydraulic equipment for supplying hydraulic power to the downhole tool 114 through the cable 116.

The coiled tubing 112 passes from the wellbore 106 through a wellhead 120 at the surface location "S" to a service rig or trailer 122. The trailer 122 may be used to transport and store various components of the wellbore system 100. For example, the trailer 122 may carry the power system 118, a controller 124 and a reel 126, around which the coiled tubing 112 is wound. The controller 120 may be operably coupled to the power system 118, downhole tool 114 and/or other components of the wellbore system 100. In some embodiments, the controller 124 may be a computer-based system that may include a processor, a memory storage device, and programs and instructions, accessible to the processor for executing the instructions utilizing the data stored in the memory storage device. In other embodiments, the controller 124 may include manual controls that may be manipulated by an operator to control the downhole tool 114 or any of the components of the wellbore system 100.

Figure 2B:
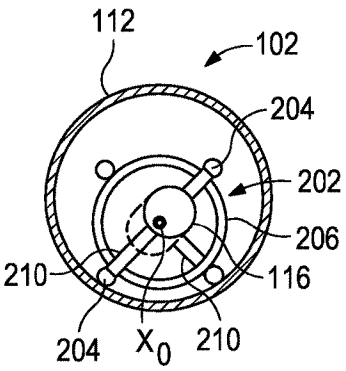
FIGS. 2A and 2B are partial, cross-sectional side and end views of a coiled tubing assembly including a cable insert with a plurality of retractable bars in an extended configuration for imparting an undulating shape to an inner cable extending within the coiled tubing.
Figure 2A:
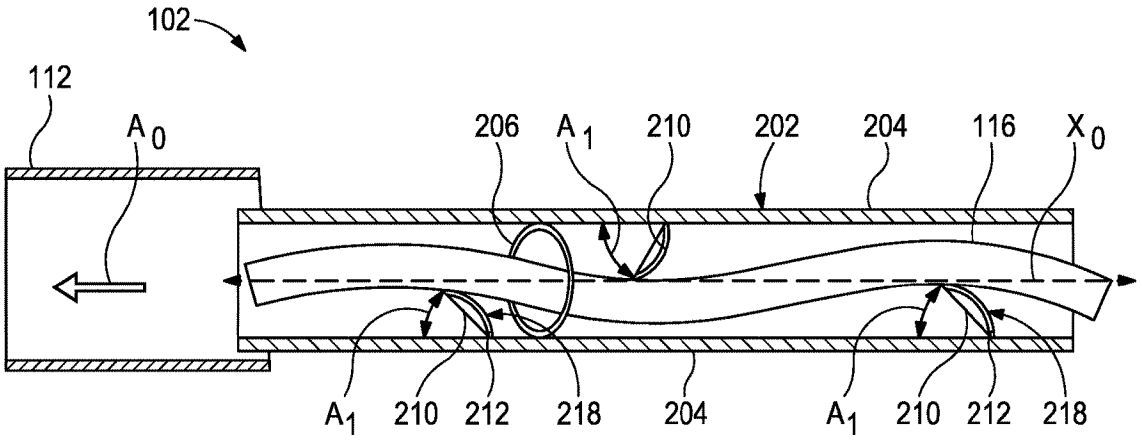

Referring now to FIGS. 2A and 2B, the tubing assembly 102 is illustrated in greater detail. The tubing assembly 102 generally includes the coiled tubing 112, the cable 116 extended within the coiled tubing 112, and an insert 202 attached to the cable 116. The insert 202 generally permits the cable 116 to be inserted into the coiled tubing 112 in an undulating configuration such that the cable 116 will have sufficient slack to accommodate operational loads on the tubing assembly 102. As illustrated in FIG. 2A, the cable 116 and the insert 202 may be inserted into the coiled tubing 112 together as indicated by arrow $A_0$.

The insert 202 includes two or more elongated rods 204 radially spaced around the cable 116 and a longitudinal axis $X_0$ of the insert 202. As illustrated in FIG. 2B, four elongated rods 204 are illustrated, but in other embodiments, more of fewer elongated rods 204 may be provided without departing from the scope of the disclosure. The elongated rods 204 may be constructed of corrosion resistant metallic materials, such as stainless steel or a nickel alloy, and/or thermoplastic materials, such as polyether ether ketones (PEEK) and acrylonitrile butadiene styrene (ABS). The thermoplastic materials may be reinforced with carbon fibers, aramid fibers or similar materials. In some embodiments, the elongated rods 204 may extend for a length of 20 feet or more, and may be substantially more rigid than the cable 116. A plurality of inserts 202 may be longitudinally spaced along the cable 116, or in other embodiments, the elongated rods 204 of a single insert 202 may extend substantially the length of the coiled tubing 112 and/or the cable 116. In some embodiments, the insert(s) 204 may extend for a length of about 10 percent of a length of the coiled tubing 112. Each insert 204 may be varied in shape or size based on the shape of the coiled tubing 112 and any predetermined need for slack at any particular location.

The elongated rods 204 may be coupled to one another by one or more ring connectors 206 circumscribing the cable 116 and longitudinally spaced along the elongated rods 204. The ring connectors 206 may be affixed to the elongated rods 204 with welds, fasteners or other couplers recognized in the art to maintain a circumferential spacing of the elongated rods 204 about the cable 116. In other embodiments, the ring connectors 206 may be monolithically formed with the elongated rods 204 with additive manufacturing processes such as 3D printing.

The insert 202 further includes a plurality of retractable bars 210 extending radially inward from the elongated rods 204. The retractable bars 210 may be constructed monolithically with elongated rods 204 and be constructed of the same materials as described above. A flexible hinge 212 may be defined between the retractable bars 210 and the elongated rods 204. The retractable bars 210 may be substantially rigid with respect to the flexible hinges 212, and the flexible hinges 212 may flex such that the retractable bars 210 may pivot in the directions of arrows $A_1$. The retractable bars 210 are biased by springs (not shown) or the materials of construction to an extended position as shown in FIGS. 2A and 2B where the retractable bars 210 extend radially inward from the hinges 212 toward the longitudinal axis $X_0$. In the extended position, the retractable bars 210 engage the cable 116 along a curved, radially inner surface 218 of the retractable bars 210. Collectively, the retractable bars 210 engage the cable 116 at longitudinal intervals from differing radial directions. Thus, the cable 116 assumes an undulating shape, crossing the longitudinal axis $X_0$ at several locations along its length. The undulating shape of the cable 116 retains slack in the cable 116. In some embodiments, the undulating shape of the cable 116 may retain about 10 percent of a length of the coiled tubing 112 as slack in the cable 116.

As illustrated in FIGS. 2A and 2B, the hinges 212 are defined at a downhole end of the retractable bars 210. In other embodiments, the hinges 212 may be defined at an uphole end of the retractable bars 210, and in still other embodiments the hinges 212 may be excluded, and the retractable bars 210 may be biased in a purely radial direction from the elongated rods 204 by compression springs (not shown) or other mechanisms to engage the cable 116 within the insert 202.

Figure 3B:
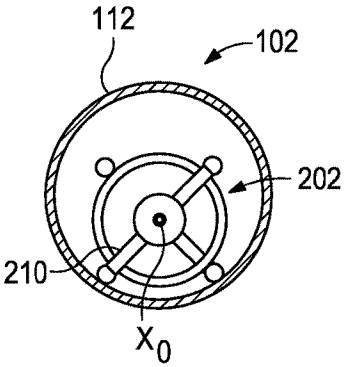
FIGS. 3A and 3B are partial, cross-sectional side and end views of a coiled tubing assembly of FIGS. 2A and 2B illustrating the retractable bars moved to a retracted configuration by straightening the cable.
Figure 3A:
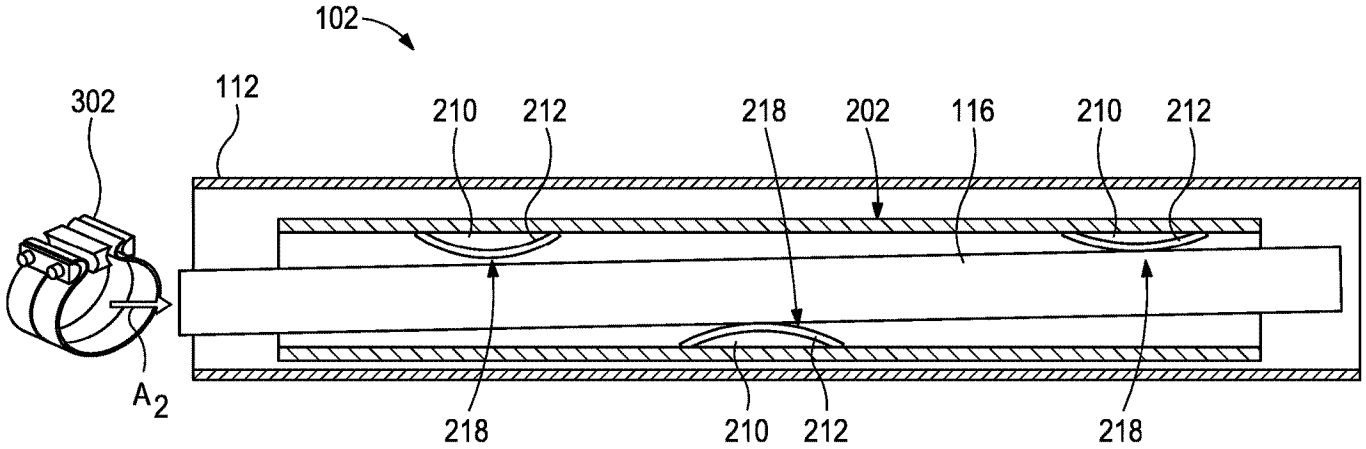

As illustrated in FIGS. 3A and 3B, the tubing assembly 102 is illustrated in an operational configuration where at least some of the extendable bars 210 are moved to a retracted position by operational forces. When the cable 116 is tensioned in operation, e.g., by friction with the coiled tubing 112, the cable 116 is straightened as the slack let out of the cable 116. The straightening of the cable 116 increases an effective length of the cable 116 within the coiled tubing 112. The cable 116 applies a radially outward force to the extendable bars 210, which causes the retractable bars 210 to pivot at the hinges 212 toward the elongated rods 204 against the radially inward bias. The curved radially inner surfaces 218 allow the retractable bars 210 to smoothly pivot without unnecessary friction on the cable 116, and in the retracted configuration, the curved radially inner surfaces 218 reduce friction with the cable 116 so that the cable 116 is not damaged in operation.

In some embodiments, one or more clamps 302 may optionally be installed on the insert(s) 202 as indicated by arrow $A_2$ to clamp the insert(s) 202 in place within the coiled tubing 112. The clamps 302 may be radially expanded or contracted to facilitate installation of the clamps 302 onto the inserts 202 and/or to grip the coiled tubing 112 once the inserts 202 are in place. In other embodiments, the inserts 202 may held in place by direct frictional contact with the coiled tubing.

Figure 4A:
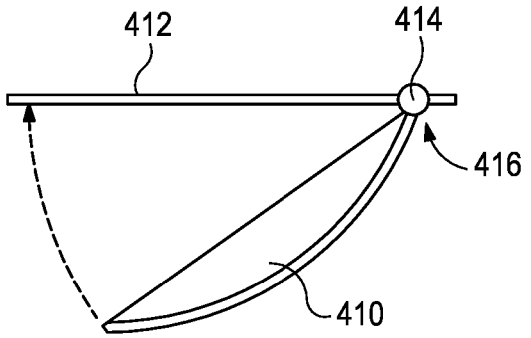
FIGS. 4A and 4B are enlarged views an alternate embodiment of an adjustable-force retractable bar in the extended and retracted configurations.
Figure 4B:
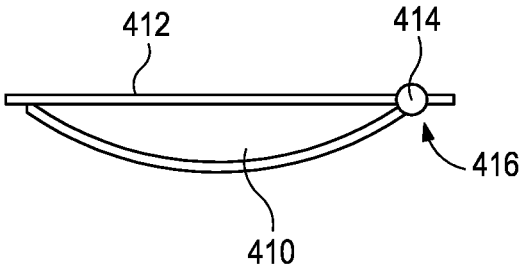

Referring now to FIGS. 4A and 4B, an adjustable-force retractable bar 410 is illustrated in extended and retracted configurations with respect to an elongated rod 412. The retractable bar 410 is coupled to the elongated rod 412 by a threaded fastener 414. In some embodiments, the threaded fastener 414 extends through a through bore (not shown) in retractable bar 410 into a threaded hole (not shown) in the elongated rod. The threaded fastener 414 is located at a hinge 416 between the retractable bar 410 and the elongated rod 412, and may be tightened to increase a force required to move the retractable bar 410 from the extended configuration illustrated in FIG. 4A to the retracted configuration of FIG. 4B. Conversely, the threaded fastener 414 may be loosened to reduce the force required to move the retractable bar 410 from the extended to retracted configuration. Thus, the threaded fastener 414 permits adjustment of the retractable bar 410 for different types of cables 116 (FIG. 1). For example, the threaded fastener 414 may be tightened for use with more rigid cables 116 to ensure the cable 116 is forced into an undulating configuration by the retractable bars 410, and loosened for less rigid cables 116 to allow the cable 116 to be straightened in response to lower tensile forces applied to the cable 116.

Figure 5:
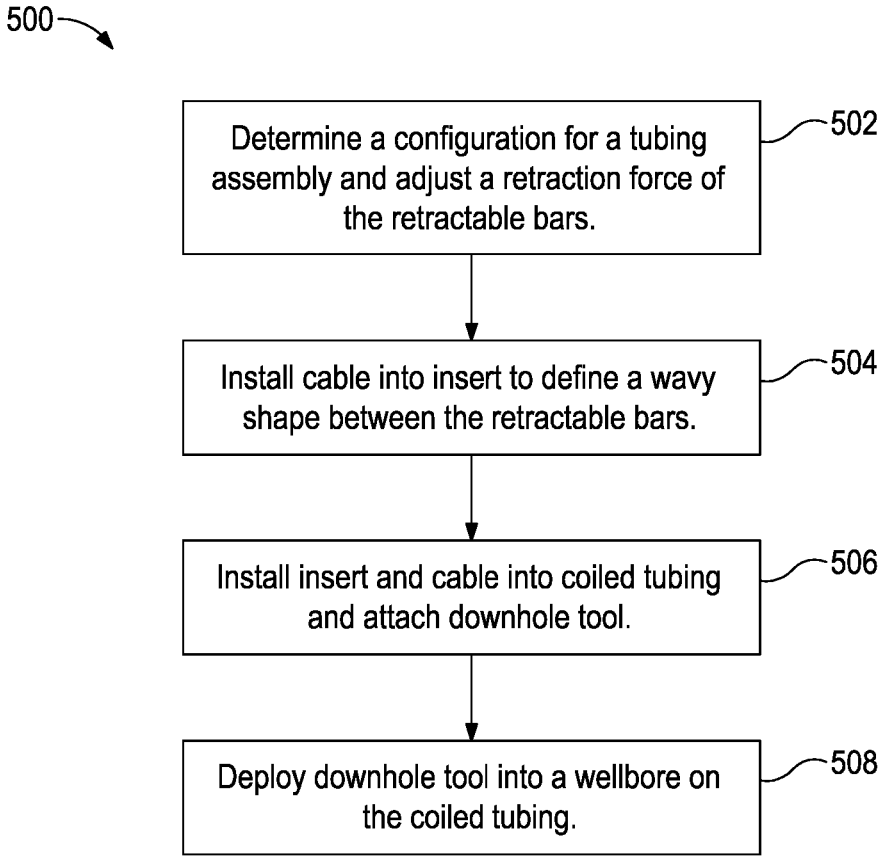
FIG. 5 is a flow chart illustrating a procedure for managing the slack of the inner cable within the coiled tubing in accordance with aspects of the present disclosure.

Referring now to FIG. 5, and with continued reference to FIGS. 1 through 4B, a procedure 500 for deploying a downhole tool 114 and managing the slack of a cable 116 within coiled tubing 112 is illustrated in accordance with aspects of the present disclosure. The procedure begins at step 502 where a configuration for a tubing assembly 102 may be determined. The location and amount of slack required in a cable 116 may be determined by observing or predicting a shape of coiled tubing 112 in a wellbore 106 and/or the tortuosity of the wellbore 106. The intervals at which inserts 202 may be placed on the cable 116 to for a particular application may be determined to provide the necessary slack in the cable 116. A force required to retract retractable bars 410 may be also be adjusted. The threaded fasteners 414 may be tightened or loosened, e.g., to accommodate a cable 116 having a particular stiffness.

Next, at step 504, the cable 116 may be installed into the insert 202. The cable 116 may be pulled through the elongated rods 204 and the ring connectors 206 to engage the retractable bars 210, 410 such that the cable defines a wavy or undulating shape between the retractable bars 210, 410. In this manner, one or more inserts 202 may be installed on the cable 116 at appropriate intervals. At step 506, the cable 116 and the insert(s) 202 may be installed together into the coiled tubing 112. The cable 116 and the insert(s) 202 may be installed in the coiled tubing by pumping a carrier fluid through the coiled tubing 112 to advance the cable 116 and the insert(s) 202, or by any method recognized for installing a cable 116 within coiled tubing 112. In some embodiments, the inserts may be clamped in place with radially extendable and contractible clamps 302, and/or inserted directly into the coiled tubing 112. The downhole tool 114 may then be coupled to a downhole end of the coiled tubing 112 and the cable 116.

Next, at step 508, an uphole end of the cable 116 may be coupled to the power system 118, and the tubing assembly 102 may be deployed into the wellbore 106. As operational forces tension the cable 116 such that additional slack is required in the cable 116, the retractable bars 210, 410 will retract toward the elongated bars 204, 412 as the cable 116 is straightened. The retractable bars 210, 410 may pivot about a hinge 212, 416 defined between the retractable bars 210, 410 and the elongated rods 204, 412 to roll a curved radially inner surface 218 of the retractable bars 210, 410 against the cable 116. When the tension in the cable 116 is relieved, the retractable bars 210, 410 will return the cable 116 to an undulating configuration. In this manner, the friction between the cable 116 and the coiled tubing will not impede deployment of the tubing assembly 102 into the wellbore 106.

Embodiments disclosed herein include:

A. A method of deploying a downhole tool can include (a) installing an insert on a cable to bias the cable into an undulating configuration, the insert including a plurality of elongated rods radially spaced around the cable and a plurality of retractable bars extending radially inwardly from the elongated rods and biased radially inward to an extended position, (b) inserting the insert and the cable through coiled tubing, (c) coupling the downhole tool to a downhole end of the coiled tubing and a downhole end of the cable; and (d) deploying the downhole tool into the wellbore on the coiled tubing such that operational forces apply a tensile force to the cable within the coiled tubing such that the cable imparts a radial outward force on the retractable bars and such that the retractable bars move radially outward to a retracted configuration.

B. A tubing assembly for deploying a downhole tool in a wellbore can include coiled tubing and a cable extending through the coiled tubing. The cable can be operable to transmit electrical and/or hydraulic signals therethrough. The assembly can further include a plurality of elongated rods disposed within the coiled tubing and radially spaced around the cable and a plurality of retractable bars extending radially inwardly from the elongated rods. The retractable bars can be biased radially inward to an extended position wherein the retractable bars flex the cable into an undulating configuration, and the retractable bars can be responsive to an increased tension in the cable to move radially outward to a retracted configuration.

C. A tubing assembly for deploying a downhole tool in a wellbore can include coiled tubing and a cable extending through the coiled tubing. The cable can be operable to transmit electrical and/or hydraulic signals therethrough. The assembly can further include a plurality of elongated rods disposed within the coiled tubing and radially spaced around the cable and a plurality of retractable bars extending radially inwardly from the elongated rods. The retractable bars can be biased radially inward to an extended position wherein the retractable bars flex the cable into an undulating configuration, and the retractable bars can be responsive to an increased tension in the cable to move radially outward to a retracted configuration.

Each of embodiments A through C may have one or more of the following additional elements in any combination: Element 1: wherein the retractable bars are coupled to the elongated rods at a flexible hinge defined between the retractable bars and the elongated rods. Element 2: wherein the retractable bars are coupled to the elongated rods with a threaded fastener at the flexible hinge, and wherein the threaded fastener is operable to adjust a force required to move the retractable bars from the extended configuration to the retracted configuration. Element 3: wherein the retractable bars define a curved radially inner surface, and wherein the curved radially inner surface is engaged with the cable when the cable when the retractable bars are in the extended and retracted configurations. Element 4: wherein the insert further comprises one or more ring connectors circumscribing the cable and affixed to each of the elongated rods to maintain a circumferential spacing of the elongated rods about the cable. Element 5: wherein the elongated rods are constructed of a thermoplastic material including at least one of polyether ether ketones (PEEK) or acrylonitrile butadiene styrene (ABS). Element 6: wherein the retractable bars are formed monolithically with the elongated rods of the thermoplastic material.

Element 7: further comprising adjusting a retraction force of the retractable bars prior to installing the insert on the cable. Element 8: wherein adjusting the retraction force includes tightening or loosening a threaded fastener extending between the retractable bars and the elongated rods at a hinge defined between the retractable bars and the elongated rods. Element 9: further comprising releasing tension from the cable and thereby returning the retractable bars to the extended configuration and the cable to the undulating configuration. Element 10: further comprising determining an amount of slack required for the cable based on an observed or predicted shape of the coiled tubing in the wellbore and a tortuosity of the wellbore. Element 11: further comprising pivoting the retractable bars about a hinge defined between the retractable bars and the elongated rods to roll a curved radially inner surface of the retractable bars against the cable. Element 12: wherein inserting the insert and the cable through the coiled tubing includes pumping a fluid through the coiled tubing to propel the insert and the cable through the coiled tubing.

Element 13: further comprising a threaded fastener disposed at a flexible hinge defined between the elongated rods and the retractable bars, and wherein the threaded fastener is operable to adjust a force required to pivot the retractable bars from the extended configuration to the retracted configuration about the flexible hinge. Element 14: wherein the retractable bars define a curved radially inner surface engaged with the cable to roll against the cable as the retractable bars pivot about the flexible hinge. Element 15: further comprising one or more ring connectors circumscribing the cable and affixed to each of the elongated rods to maintain a circumferential spacing of the elongated rods about the cable. Element 16: wherein the retractable bars are formed monolithically with the elongated rods with a flexible hinge defined between the retractable bars and the elongated rods. Element 17: wherein the elongated rods, retractable bars and flexible hinge is constructed of a thermoplastic material including at least one of polyether ether ketones (PEEK) or acrylonitrile butadiene styrene (ABS).

By way of non-limiting example, exemplary combinations applicable to A through C include: Element 1 with Element 2; Element 2 with Element 3; Element 5 with Element 6; Element 7 with Element 8; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore system, comprising:

coiled tubing extending into a wellbore from a surface location;

a downhole tool coupled to a downhole end of the coiled tubing;

a cable extending through the coiled tubing and operably coupled to the downhole tool within the wellbore; and an insert disposed within the coiled tubing and engaging the cable, the insert including:

a plurality of elongated rods radially spaced around the cable and defining a longitudinal axis of the insert; and a plurality of retractable bars pivotally coupled to the elongated rods by a flexible hinge defined between the plurality of retractable bars and the elongated rods, the retractable bars extending radially inwardly from the elongated rods and biased radially inward to an extended position wherein the retractable bars collectively engage the cable from differing radial directions at longitudinal intervals, wherein each retractable bar flexes the cable into an undulating configuration with respect to the longitudinal axis, wherein the undulating configuration retains at least 10 percent of a length of the coiled tubing as slack in the cable, and wherein each retractable bar is responsive to an increased tension in the cable to move radially outward to a retracted configuration.

2. The wellbore system of claim 1, wherein the plurality of retractable bars is coupled to the elongated rods with a threaded fastener at the flexible hinge, and wherein the threaded fastener is operable to adjust a force required to move the plurality of retractable bars from the extended configuration to the retracted configuration.

3. The wellbore system of claim 2, wherein each retractable bar defines a curved radially inner surface that is curved in a longitudinal direction, and wherein the curved radially inner surface is engaged with the cable when the cable and rolls against the cable when each retractable bar is moved between the extended and retracted configurations.

4. The wellbore system of claim 1, wherein the insert further comprises one or more ring connectors circumscribing the cable and affixed to each of the elongated rods to maintain a circumferential spacing of the elongated rods about the cable.

5. The wellbore system of claim 1, wherein the elongated rods are constructed of a thermoplastic material including at least one of polyether ether ketones (PEEK) or acrylonitrile butadiene styrene (ABS).

6. The wellbore system of claim 5, wherein the plurality of retractable bars is formed monolithically with the elongated rods of the thermoplastic material.

7. The wellbore system of claim 1, wherein the retractable bars are substantially more rigid than the cable.

8. The wellbore system of claim 1, wherein the insert is sized such that at least one of the elongated rods is spaced radially from the coiled tubing.

9. A method of deploying a downhole tool on coiled tubing, the method comprising:

installing an insert on a cable to bias the cable into an undulating configuration that retains at least 10 percent of a length of the coiled tubing as slack in the cable, the insert including a plurality of elongated rods radially spaced around the cable and a plurality of retractable bars pivotally coupled to the elongated rods by a flexible hinge defined between the plurality of retractable bars and the elongated rods, the retractable bars extending radially inwardly from the elongated rods and biased radially inward to an extended position wherein the retractable bars collectively engage the cable from differing radial directions at longitudinal intervals;

inserting the insert and the cable through the coiled tubing;

coupling the downhole tool to a downhole end of the coiled tubing and a downhole end of the cable; and deploying the downhole tool into the wellbore on the coiled tubing such that operational forces apply a tensile force to the cable within the coiled tubing such that the cable imparts a radial outward force on the plurality of retractable bars and such that the plurality of retractable bars pivot radially outward to a retracted configuration by rolling a curved radially inner surface of the plurality of retractable bars against the cable.

10. The method of claim 9, further comprising adjusting a retraction force of the plurality of retractable bars prior to installing the insert on the cable.

11. The method of claim 10, wherein adjusting the retraction force includes tightening or loosening a threaded fastener extending between the plurality of retractable bars and the elongated rods at a hinge defined between the plurality of retractable bars and the elongated rods.

12. The method of claim 9, further comprising releasing tension from the cable and thereby returning the plurality of retractable bars to the extended configuration and the cable to the undulating configuration.

13. The method of claim 9, further comprising determining an amount of slack required for the cable based on an observed or predicted shape of the coiled tubing in the wellbore and a tortuosity of the wellbore.

14. The method of claim 9, wherein inserting the insert and the cable through the coiled tubing includes pumping a fluid through the coiled tubing to propel the insert and the cable through the coiled tubing.

15. A tubing assembly for deploying a downhole too in a wellbore, the tubing assembly comprising:

coiled tubing;

a cable extending through the coiled tubing and operable to transmit electrical and/or hydraulic signals therethrough;

a plurality of elongated rods disposed within the coiled tubing and radially spaced around the cable; and a plurality of retractable bars pivotally coupled to the elongated rods by a flexible hinge defined between the plurality of retractable bars and the elongated rods, the retractable bars extending radially inwardly from the elongated rods and biased radially inward to an extended position wherein the retractable bars collectively engage the cable from differing radial directions at longitudinal intervals, wherein the plurality of retractable bars flexes the cable into an undulating configuration, wherein the undulating configuration retains at least 10 percent of a length of the coiled tubing as slack in the cable, and wherein the plurality of retractable bars is responsive to an increased tension in the cable to move radially outward to a retracted configuration.

16. The assembly of claim 15, further comprising a threaded fastener disposed at the flexible hinge defined between the elongated rods and the plurality of retractable bars, and wherein the threaded fastener is operable to adjust a force required to pivot the plurality of retractable bars from the extended configuration to the retracted configuration about the flexible hinge.

17. The assembly of claim 15, wherein the retractable bars define a curved radially inner surface engaged with the cable to roll against the cable as the plurality of retractable bars pivot about the flexible hinge.

18. The assembly of claim 15, further comprising one or more ring connectors circumscribing the cable and affixed to each of the elongated rods to maintain a circumferential spacing of the elongated rods about the cable.

19. The assembly of claim 15, wherein the plurality of retractable bars are formed monolithically with the elongated rods with the flexible hinge defined between the plurality of retractable bars and the elongated rods.

20. The assembly of claim 19, wherein the elongated rods, the plurality of retractable bars and the flexible hinge are each constructed of a thermoplastic material including at least one of polyether ether ketones (PEEK) or acrylonitrile butadiene styrene (ABS).

* * * * *